United States Patent [19]

Hadfield

[11] Patent Number: 4,546,809

[45] Date of Patent: Oct. 15, 1985

[54] DUAL TRACK DRAPERY SUPPORT DEVICE

[76] Inventor: Elden E. Hadfield, 1533 Meadowlark La., Lakepoint, Utah 84074

[21] Appl. No.: 555,178

[22] Filed: Nov. 25, 1983

[51] Int. Cl.[4] ..... A47H 1/10

[52] U.S. Cl. ..... 160/126

[58] Field of Search ..... 160/126, 330, 345, 123, 160/124, 19; 16/93 R, 94 D, 95 D, 96 D

[56] References Cited

U.S. PATENT DOCUMENTS

| | | | |
|---|---|---|---|
| 3,183,546 | 5/1965 | Heller et al. | 16/94 D |
| 3,672,425 | 6/1972 | Schulze-Robbecke et al. | 160/345 |
| 3,700,022 | 10/1972 | Eaves | 160/126 |
| 3,743,002 | 4/1973 | Ford | 160/126 |
| 3,975,792 | 8/1976 | Janson | 16/96 D |
| 4,355,677 | 10/1982 | Madsen | 160/126 |

FOREIGN PATENT DOCUMENTS 1467343 12/1966 France .

*Primary Examiner*—Ramon S. Britts
*Assistant Examiner*—Cherney S. Lieberman
*Attorney, Agent, or Firm*—Silverman, Cass & Singer, Ltd.

[57] ABSTRACT

A unitary dual track for retaining drapery panels each suspended from movable apertured lugs in the tracks. The tracks are offset so as to provide a clearance space which permits fasteners to be inserted through a top wall common to the tracks into a ceiling for mounting thereof, and shield means to bridge said space. An integrally formed master carrier member is slidably retained in each track which includes a plurality of depending lugs each having an aperture for receipt therein of hooks secured to the lead portion of a drapery panel, and a wand for moving the master carrier and the drape panel attached thereto with reduced stress on the lead portions of the drapery panels.

5 Claims, 5 Drawing Figures

FIG. 1
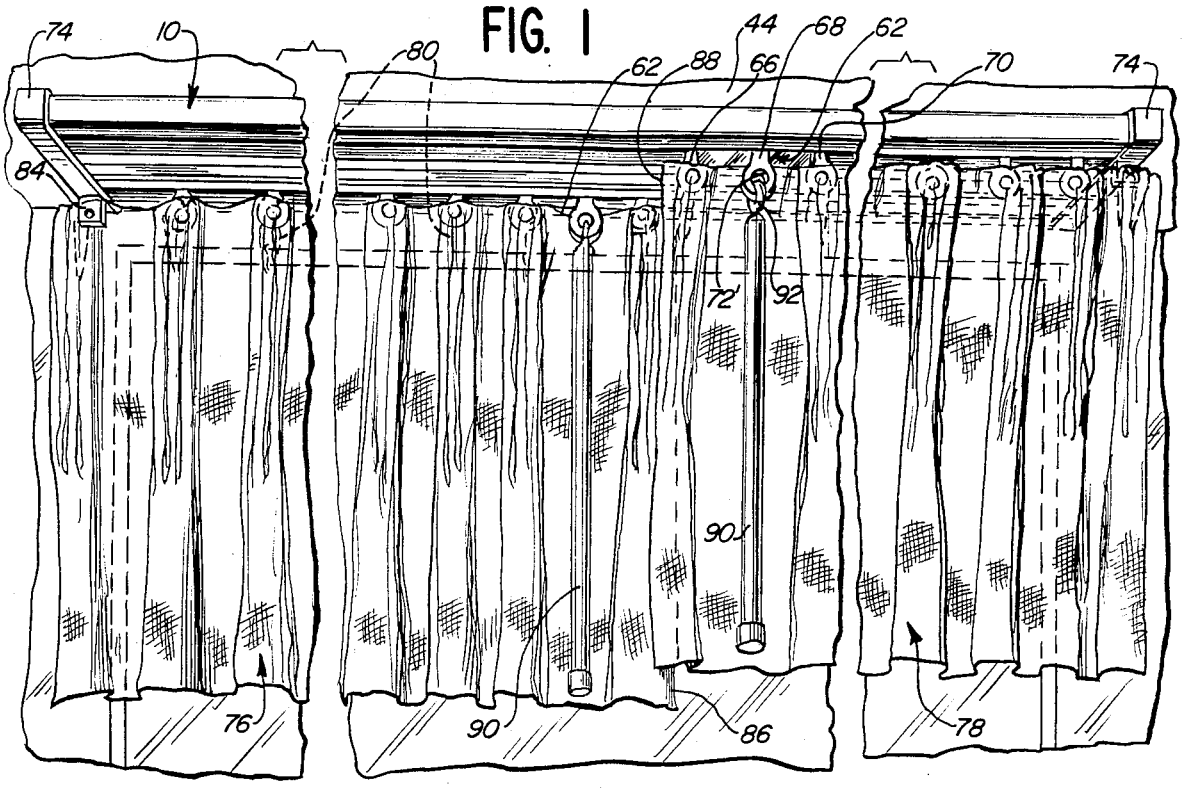
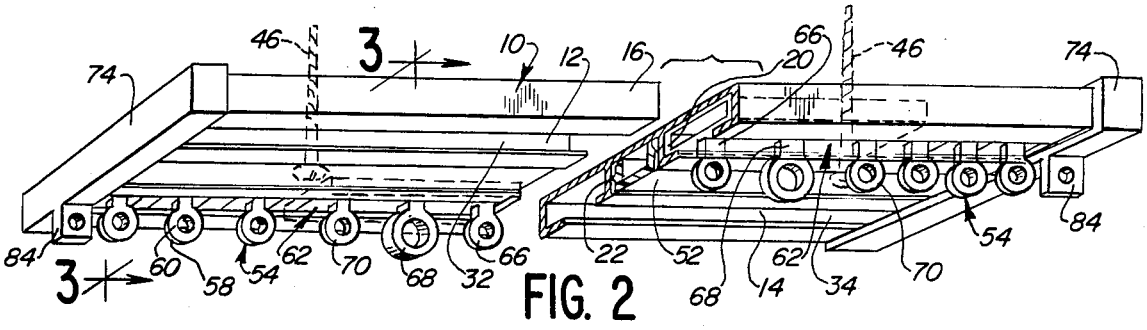
FIG. 2
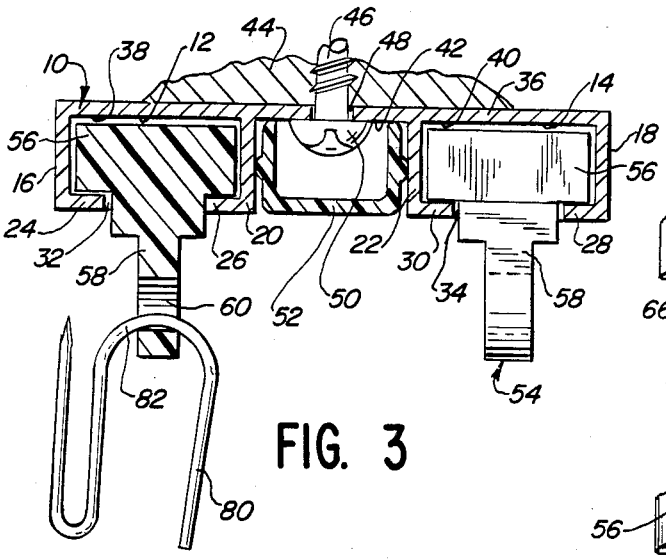
FIG. 3
FIG. 4
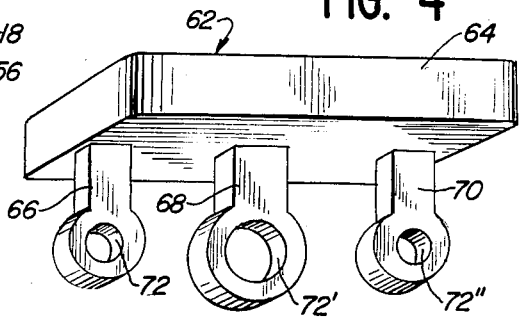
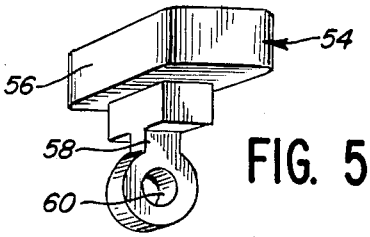
FIG. 5

DUAL TRACK DRAPERY SUPPORT DEVICE

BACKGROUND OF THE INVENTION

1. Field of the Invention

This invention relates generally to drapery support devices and, more particularly, to such devices having multiple tracks for supporting drapery panels suspended from carriers retained in said tracks.

2. Description of the Prior Art

There are many types of drapery support devices known in the art. Such devices commonly are used to support draperies or room divider panels suspended from a ceiling for aesthetic and/or utilitarian purposes.

Structures known in the art for supporting drapery panels commonly include either single or multiple track traverse bars in which carrier members are movable along the length thereof. The drapery panels may be provided with pins or hooks with their bight portions engaged in apertures formed in the carriers for supporting the panels from the tracks. It also is known in the art to provide for the use of draw rods positionable proximate the lead edge of the suspended drapery panels for movement of the drapery panels along the support device to open or close the same. Drapery support devices of the type described above are illustrated in the following U.S. Pat. Nos. 2,419,486; 3,743,002; 2,848,734; 3,883,924; 2,966,695; 3,975,792; 3,248,749; 3,983,921; 3,278,980; 4,357,983.

Although these prior patents describe a variety of types of drapery support devices, none of the patents shows a dual track drapery support device including a plurality of depending, movable individual carriers for supporting the drapery panels, and a respective integral master carrier positioned in each track for supporting the lead edge of respective drapery panels therefrom and moving the individual carriers positioned on the track behind the master carrier when said master carrier is moved to open said drapery panels. The device of the present invention provides such a dual track drapery support device with an integral master carrier with multiple depending lugs for supporting the lead edge of a drapery panel to facilitate opening and closing of the panels without applying such force thereto which might tear or distort the panels in their hanging mode.

SUMMARY OF THE INVENTION

The invention is characterized by a unitary, sheet metal dual track drapery support device including a pair of channels separated by a space therebetween. A plurality of apertured individual carriers and a single master carrier having multiple lugs is slidably positioned within each channel. The master carriers are formed with at least three depending lugs, each having an aperture therein. Drapery panels are suspended from said carriers; the lead edge of a drapery panel is secured to the lugs of said master carrier. A rod or wand for moving the drape is engaged in the center one of the lugs of said master carrier. Movement of the master carrier by manipulating the wand moves the other carriers positioned on the track behind said master carrier to open the drapery panel as desired, but without stressing the fabric of the drapery panel.

BRIEF DESCRIPTION OF THE DRAWING

FIG. 1 is a front elevational view of a pair of drape panels supported by the dual track drapery device of the invention.

FIG. 2 is a perspective view of the dual track drapery device of the invention.

FIG. 3 is a sectional view taken along the line 3—3 of FIG. 2 in the direction indicated generally.

FIG. 4 is a perspective view of a master carrier constructed in accordance with the invention.

FIG. 5 is a perspective view of a carrier constructed in accordance with the invention.

DESCRIPTION OF THE PREFERRED EMBODIMENT

Referring to the drawing, drapery support member 10 is formed preferably as an elongate aluminum extrusion or bar which may be cut to any desired length. Support member 10 is of generally rectangular cross-sectional configuration and includes a pair of channel formations or tracks 12, 14 extending the elongate length thereof. Tracks 12, 14 have respective outer-facing side walls 16, 18 and respective inner-facing side walls 20, 22. Each respective side wall 16, 20 is formed with return bent flanges 24, 26 to partially close off the track formation 12, as seen in FIG. 3. Likewise, each respective side wall 18, 22 is formed with return bent flanges 28, 30 to partially close off the track formation 14. In this manner, each track 12, 14 has a respective opening 32, 34 defined by the terminal ends of return bent flanges 24, 26 and 28, 30.

Drapery support member 10 includes a wall 36 extending between tracks 12, 14 and forming the rear walls 38, 40, respectively, of said tracks. Tracks 12, 14 are joined by the common wall 36 but separated from each other by the distance defined by spacing portion 42 of wall 36.

Support member 10 is adapted for mounting to a ceiling 44 or the like by fasteners, such as screws 46, which are insertable through apertures 48 formed in spacing portion 42 at selected locations therealong. When so positioned, the heads 50 of screws 46 are disposed at a location removed from the openings 32, 34 in tracks 12, 14 so as not to interfere with operation of the drapery support member 10 as described hereinafter. Shield 52 may be positioned between inner facing walls 20, 22 of tracks 12, 14 to cover screw heads 50 to enhance the aesthetic appearance of support member 10.

A plurality of individual carriers 54 are mounted for movement in tracks 12, 14 and slidable therein. Each individual carrier 54 includes a generally rectangularly-shaped body portion 56 with a depending lug 58 formed integrally with the body portion 56. Each lug 58 has an aperture 60 formed therein. The cross-sectional configuration of body portion 56 is approximately the same as the cross-sectional configuration of tracks 12, 14 defined by the respective walls forming said tracks. Further, the cross-sectional configuration of lugs 58 is such as to permit the same to pass through the openings 32, 34 in the respective tracks to depend below channel support member 10 when the same is secured to ceiling 44. A plurality of said carriers 54 are positioned within tracks 12, 14 by inserting the same through an open end (not shown) thereof.

A master carrier 62 is positioned in each respective track 12, 14 with a preselected number of carriers 54 located in said tracks behind each master carrier 62.

Master carrier 62 includes a generally rectangularly-shaped, elongate body portion 64 with three integral depending lugs 66, 68, 70 formed integrally therewith. Each lug 66, 68, 70 includes an aperture 72, 72', 72" formed therein. In the same manner as with respect to carriers 54, the cross-sectional configuration of body portion 64 of master carrier 62, is such as to enable the master carrier to be positioned within tracks 12, 14 with lugs 66, 68, 70 depending through openings 32, 34 in the respective tracks. Master carriers 62 are positionable within tracks 12, 14 by inserting the same through an open end (not shown) of the tracks, which open end is covered by end cap 74 after carriers 54, 62 are positioned in the tracks. Preferably, the carriers 62 are molded plastic members of integral construction, although other materials or combinations thereof are feasible.

Drapery support member 10 retains drapery panels 76, 78 in suspended fashion by hooks or pins 80 each having a bight 82 extended through apertures 60 of carriers 54. Preferably, the number of carriers 54 positioned in tracks 12, 14 corresponds to the number of pleats of drapery panels 76, 78 and there is a hook 80 for each such pleat positioned in a carrier 54 to fully support the drapery panels along the length thereof. End caps 74 are formed with depending apertured lugs 84 to accommodate hooks 80 for support of the drapery return at the ends of the support member 10.

The lead edge 86, 88 of respective drapery panels 76, 78 is secured to a master carrier 62. A first hook 80 positioned proximate lead edge 86, 88 is disposed within aperture 72 of lug 66 of master carrier 62. A second hook 80 is positioned a short distance from lead edge 86, 88 at the first pleat in the drapery panel and this hook is positioned through aperture 72" in lug 70. A rod or wand 90 is secured to the center lug 68 of master carrier 62 by a hook 92 passing through aperture 72' thereof. Rod 90 extends to a location below master carrier 62 so that the master carrier may be moved by movement of the rod. Movement of master carrier 62 toward end cap 74 of support member 10 causes each carrier 54 positioned along the track in which master carrier 62 is located also to move behind the master carrier. It will be noted that the master carrier is really elongated so that the wand or rod can be manipulated to apply force to the carrier which is distributed over its length but not directly to the drapery on opposite sides of the center lug 68. Thus, the lugs holding the drapery and hence the hooks engaged therein are not stressed when the rod is pulled or moved.

It will be seen that each drapery panel is supported along a separate track 12, 14 for independent movement on the track, as desired. Closure of the drapery panels is smooth, and opening and closing of the panels is facilitated without applying such force to the drapery panel material which might tear or distort them in their hanging mode. Stop members may selectively be located in the tracks for determining the desired closure position of the respective drapery panels.

Although not specifically illustrated, it is contemplated that this dual track structure also can be employed where one of the drapery panels is a blackout or opaque panel and the second drapery panel is of a decorative material such as casement which transmits light more readily. In such an installation, the opaque drapery panel would be of sufficient material to span across a window; and the same would apply for the decorative drapery fabric. The master carrier would still be installed at the lead edge of each panel, but in the fully extended condition of the panels, the panels would not meet at the center of the track.

Minor variations in the structure and other variations in the arrangement and size of the various parts may occur to those skilled in the art without departing from the spirit or circumventing the scope of the invention as set forth in the appended claims.

I claim:

1. A drapery support device comprising, an elongate bar, said bar being of generally rectangular cross-sectional configuration and including a pair of elongate tracks extending the length thereof, said tracks arranged in parallel disposition with a space therebetween, each track including an inner facing side wall, said space being defined by an extension between said inner facing side walls joining said tracks, a plurality of apertures formed in said extension to permit securement of said support device to a surface by fasteners disposed through said apertures into said surface, said fasteners being positioned at a location between said tracks when disposed through said apertures, removable imperforate shield means extending between said inner facing side walls to decoratively bridge said space and conceal said fasteners, a plurality of carriers disposed in said tracks for slidable movement therein, each carrier having a lug formed theron and projecting beyond said tracks, a master carrier positioned in each respective track for slidable movement therein with a preselected number of carriers located in said tracks behind each master carrier, a plurality of depending lugs formed on each said master carrier projecting beyond said tracks, means to secure a drapery panel to each carrier, means for securing a lead edge of a drapery panel to a respective master carrier, and means for movement of said master carriers along said tracks whereby movement of a master carrier causes each carrier positioned along the track in which the master carrier is located also to move behind the master carrier.

2. A drapery support device as claimed in claim 1 in which each said master carrier includes a generally rectangularly-shaped elongate body portion with at least three depending lugs formed integrally therewith.

3. A drapery support device as claimed in claim 2 in which each said lug has an aperture formed therein, and said means to secure said drapery panels to said master carriers comprise a plurality of hooks secured to said drape panels and extended through said apertures.

4. A drapery support device as claimed in claim 3 in which the lead edge of said drapery panel is secured to two lugs of said master carrier.

5. A drapery support device as claimed in claim 4 in which said means to move said master carrier includes a rod secured to one of said lugs on the master carrier.

* * * * *